US007427036B2

(12) United States Patent
Skluzacek et al.

(10) Patent No.: US 7,427,036 B2
(45) Date of Patent: Sep. 23, 2008

(54) ILLUMINATED FLOATING FOUNTAIN

(75) Inventors: Richard William Skluzacek, Cottage Grove, MN (US); Douglas John Calvert, Hudson, WI (US); Raymond Harris Lee, Hudson, WI (US)

(73) Assignee: Kasco Marine, Inc., Prescott, WI (US)

( * ) Notice: Subject to any disclaimer, the term of this patent is extended or adjusted under 35 U.S.C. 154(b) by 238 days.

(21) Appl. No.: 11/043,463

(22) Filed: Jan. 25, 2005

(65) Prior Publication Data

US 2006/0163375 A1 Jul. 27, 2006

(51) Int. Cl.
*F21S 8/00* (2006.01)

(52) U.S. Cl. ..... 239/18; 239/23

(58) Field of Classification Search ..... 239/16, 239/17, 18, 22, 23

See application file for complete search history.

(56) References Cited

U.S. PATENT DOCUMENTS

| | | | | |
|---|---|---|---|---|
| 3,307,787 | A * | 3/1967 | Hall, Jr. | 239/17 |
| 5,931,382 | A | 8/1999 | Gross et al. | |
| 6,053,423 | A | 4/2000 | Jacobsen et al. | |
| 6,276,612 | B1 | 8/2001 | Hall | |
| 6,375,090 | B1 | 4/2002 | Beidokhti | |
| 6,435,422 | B1 | 8/2002 | Wutschik | |
| 6,565,940 | B1 | 5/2003 | Lin | |
| 6,607,144 | B1 | 8/2003 | Yen | |
| 6,755,349 | B2 | 6/2004 | Beidokhti | |
| 6,779,739 | B2 | 8/2004 | Mulvaney | |

OTHER PUBLICATIONS

Brochure, "Kasco® Aeration," Kasco Marine, Inc., Prescott, WI, 6 pages (1992).

Assembly Instructions for Kasco Decorative Aerators, Models F2400/VF, F3400/VF, F3400H/VF, 4400/VF and 4400H/VF, Kasco Marine, Inc., Prescott, WI, 1 page (2000).

Assembly Instructions for Kasco Pond Aerators, Models 4400/AF, 4400H/AF, and 8400/AF, Kasco Marine, Inc., Prescott, WI, 2 pages (2000).

Assembly Instructions for Kasco Decorative Aerators, Model 8400/JF, Kasco Marine, Inc., Prescott, WI, 2 pages (2000).

Product Literature, "Note: Alternate installation for ponds with drastic fluctuations in water level," Kasco Marine, Inc., Prescott, WI, 1 page (2002).

(Continued)

*Primary Examiner*—Christopher S Kim
(74) *Attorney, Agent, or Firm*—Merchant Gould P.C.

(57) ABSTRACT

A floating fountain apparatus includes a buoyant annular float having a central opening. A pump is secured to a lower side of the float. The pump has a propeller positioned to direct water through the central opening. A pump housing is positioned to receive water flow from the propeller and direct the water flow to a nozzle outlet. A lighting assembly is positioned within the central opening. The pump housing includes an upper pump housing and a lower pump housing. The lower pump housing has a water inlet and a hollow cylindrical outlet. The upper pump housing is slidably received within the cylindrical outlet and has a flow diverting surface to direct flow against an inner surface of the cylindrical outlet to create an annular flow of water. A plurality of vanes extends between the outer and inner members to divide a spacing between the members into a plurality of individual fluid flow pathways.

4 Claims, 6 Drawing Sheets

OTHER PUBLICATIONS

Nozzle Options and Pattern Sizes for Kasco Model 8400/JF Decorator Aerator, Kasco Marine, Inc., Prescott, WI, 1 page (1999).
Owner's Manual, Aqua Series Fractional Aerator, Otterbine Barebo, Inc., 18 pages (2004).
Brochure, "Enhancing Waterways," Otterbine Barebo, Inc., 19 pages (1998).
Brochure, "The Clear Choice," Aqua Mater, Inc., 8 pages (1998).
"Strata-vator™ Fountain Products Catalog," Oase Pumps, Inc, 12 pages (1997).
"Aerating Fountains: Gemini Lake Fountain Aerators," http://www.otterbine.com/default.aspx?pageid=9, 2 pages, dated printed Jan. 14, 2005.

* cited by examiner

ILLUMINATED FLOATING FOUNTAIN

BACKGROUND OF THE INVENTION

1. Field of the Invention

This invention pertains to floating fountains for placement in a body of water such as a pond or the like. More particularly, this invention pertains to a floating fountain having illumination of an ornamental spray pattern.

2. Description of the Prior Art

Owners of pools or ponds may desire to provide additional ornamentation to such landscape features by adding a fountain. In addition to aerating the water in the pond or pool, the fountain provides an aesthetically pleasing ornamental spray pattern. Lighting enhances the ornamental appearance. Examples of floating fountains are shown in U.S. Pat. Nos. 5,931,382; 6,375,090; 6,435,422; 6,565,940 and 6,755,349. Floating fountains can be very expensive and come in a wide variety of sizes (measured by the horse power of a pump motor). Commonly, the cost increases with the size of the fountain.

The construction and design of a fountain should be selected to maintain quality while providing a simplicity of components to reduce cost and maintenance. Further, it is desirable for a fountain owner to be able to adjust a spray pattern from time to time. The aforementioned U.S. Pat. No. 5,931,382 describes an aerating fountain with a selectable nozzle to alter a spray pattern. Manually changeable spray nozzles are also known. However, manual changing of nozzles can be very time consuming. Indeed, one manufacturer of a floating fountain advertises that a nozzle can be changed in 20 minutes (www.otterbine.com (Jan. 14, 2005)). This is a long period of time.

In addition to changing a nozzle spray pattern, it is desirable to provide lighting for a fountain. Fountains typically come with incandescent lighting, which may be attached to a float or may be separately provided as part of the fountain installation. Such incandescent lighting is expensive and bulky as well as providing only limited lighting opportunities. U.S. Pat. No. 6,607,144 describes a fountain pot which includes a set of light emitting diodes for illuminating a fountain in the particular apparatus shown in the '144 patent.

It is an object of the present invention to provide a floating fountain of a design to permit low cost manufacture while retaining high quality performance, to permit ready interchangeability of fountain nozzles to alter a spray pattern and to provide an improved illumination of a spray pattern.

SUMMARY OF THE INVENTION

According to a preferred embodiment of the present invention, a floating fountain apparatus is disclosed for creating a patterned spray of water in a body of water. The apparatus includes a buoyant annular float having a central opening. A pump is secured to a lower side of the float. The pump has a propeller positioned to direct water through the central opening. A pump housing is positioned to receive water flow from the propeller and direct the water flow to a nozzle outlet. In one embodiment, a lighting assembly is positioned within the central opening. The lighting assembly includes a mounting ring carrying a plurality of light emitting diodes. In another embodiment, the pump housing includes an upper pump housing and a lower pump housing. The lower pump housing has a water inlet and a hollow cylindrical outlet. The upper pump housing is slidably received within the cylindrical outlet and has a flow diverting surface to direct flow against an inner surface of the cylindrical outlet to create an annular flow of water. A plurality of vanes extends between the outer and inner members to divide a spacing between the members into a plurality of individual fluid flow pathways. A nozzle is connected to the pump housing. The nozzle has a surface configuration to the fluid flow and spray the flow in a spray pattern. In a still further embodiment, the fountain includes a kit of interchangeable nozzles.

DETAILED DESCRIPTION OF THE PREFERRED EMBODIMENT

Referring now to the several drawing figures in which identical elements are numbered identically throughout, a description of a preferred embodiment of the present invention will now be described with reference to the various drawing figures in which similar elements are numbered identically throughout.

Figure 1:
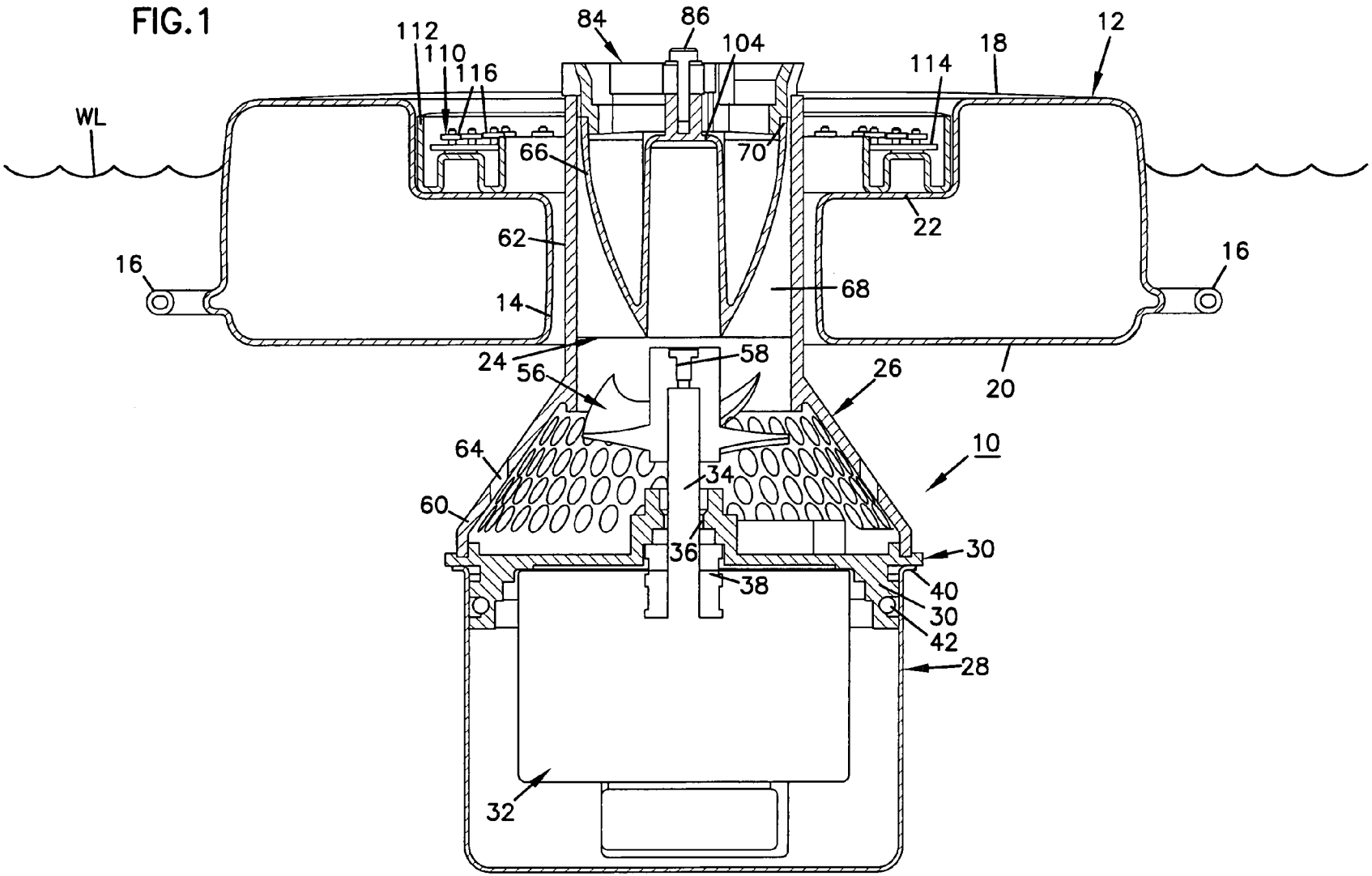
FIG. 1 is a cross-sectional assembled view of a floating fountain according to the present invention.

With initial reference to FIG. 1, the present invention is shown as an illuminated floating fountain 10 for placement in a body of water such as a pond, pool or the like. The fountain provides aeration of the water as well as providing an ornamental pattern of water sprayed from the fountain.

The design of the fountain 10 is particularly suitable for smaller sized fountains. With respect to floating fountains, the term "size" is generally understood to refer to the power rating of the motor driving the fountain 10. A one-quarter horsepower motor is generally considered a small size for a floating fountain. Fountain sizes may go as high as 25 horsepower or more.

The fountain 10 includes a torroidal or annular float 12 which is of hollow construction to contain a buoyant material or air in a sealed manner within the interior of the float 12 to create buoyancy. The float 12 has a central opening 14 sized to pass pump components as will be described. The float 12 includes eyelets 16 for attachment of cables (not shown), which may be attached to anchors or tethered to landscape structures in order to fix a positioning of the fountain 10 within a body of water.

The float 12 has an upper surface 18 and a lower surface 20. The lower surface 20 is placed on the water surface. The upper surface 18 faces away from the water surface in use of the fountain 10. The upper surface 18 has an annular recess 22 the function of which will become apparent. The weight of the fountain 10 will at least partially submerge the float 12 below a water line WL.

The pumping components include an upper pump housing 24, a lower pump housing 26, a motor enclosing can 28 and a can cover 30. The can 28 is sized to receive an electrical motor 32 having a rotating motor shaft 34.

The cover 30 encloses the can with the motor 32 retained within the can 28 and with a shaft 34 extending through a central aperture 36 of the cover 30. A shaft seal 38 and lip seal 39 seal the spacing between the shaft 34 and the cover 30 to prevent fluid flow through the aperture 36. The cover 30 is press fit into the can with the cover abutting a flange 40 at the open end of the can. An O-ring 42 provides a fluid tight seal between the can 28 and the cover 30.

The can 28 may be filled with oil. To facilitate excess to the oil within the can 28 without need to remove the cover 30, a sealing plug 44 and sealing washer 46 (best shown with reference to FIG. 2) cover a hole formed in the cover to permit selective access to the interior of the can 28. Also, a power cord 50 (shown in FIG. 2) is admitted through a hole 52 in the cover 30 and sealed by an O-ring 54. The power cord 50 provides power to the motor 32. The power cord 50 is selected to be long enough so that it may extend to a power outlet located away from the body of water in which the fountain 10 is placed.

A propeller 56 has internal threads for the propeller to be screwed onto external threads at the end of the shaft 34. The propeller 56 has vanes to urge water to flow from the bottom side of the float 20 towards the upper side 18. The lower pump housing 26 surrounds the propeller 56.

As shown in the drawings, the lower pump housing 26 includes a conical portion 60 and a cylindrical portion 62. The cylindrical portion 62 is sized to have a length such that the propeller 56 is positioned at the juncture of the cylindrical portion 62 and the conical portion 60. The interior diameter of the cylindrical portion 62 is sized to be approximate to or only slightly greater than the outside diameter of the rotating propeller 56.

With this arrangement and sizing, the conical portion 60 is a fluid inlet to the pumping mechanism and the cylindrical portion 62 is a fluid outlet. The conical portion 60 has a plurality of holes 64 formed through the wall of the conical portion 60 to provide water flow from the surrounding body of water to the inlet side of the propeller 56. The conical portion 62 has a recessed portion 61 (shown in FIG. 2) to provide clearance for cords 50, 118.

The upper pump housing 24 (shown best in FIG. 3) has an inverted conical wall 66 and a plurality of radially extending vanes 68. The vanes 68 are sized to have a total outside diameter equal to the inside diameter of the cylindrical portion 62 such that the vanes 68 retain the conical wall 66 axially aligned within the cylindrical portion 62.

The conical wall 66 is sized to substantially abut the upper end of the propeller 56 spaced therefrom by only a small amount to provide adequate clearance during use. The conical wall 66 urges water flow from the propeller 56 against the inner wall of the cylindrical member 62. The vanes 68 segment the water flow into a plurality of circumferentially spaced flows around a flow axis parallel to the axis of cylinder 62. The upper pump housing 24 terminates at a nozzle outlet end 70 where the conical wall 66 is narrowly spaced from the cylindrical portion 62 resulting in high velocity flow of a plurality of streams of water from each of the chambers defined between the vanes 68.

Figure 2:
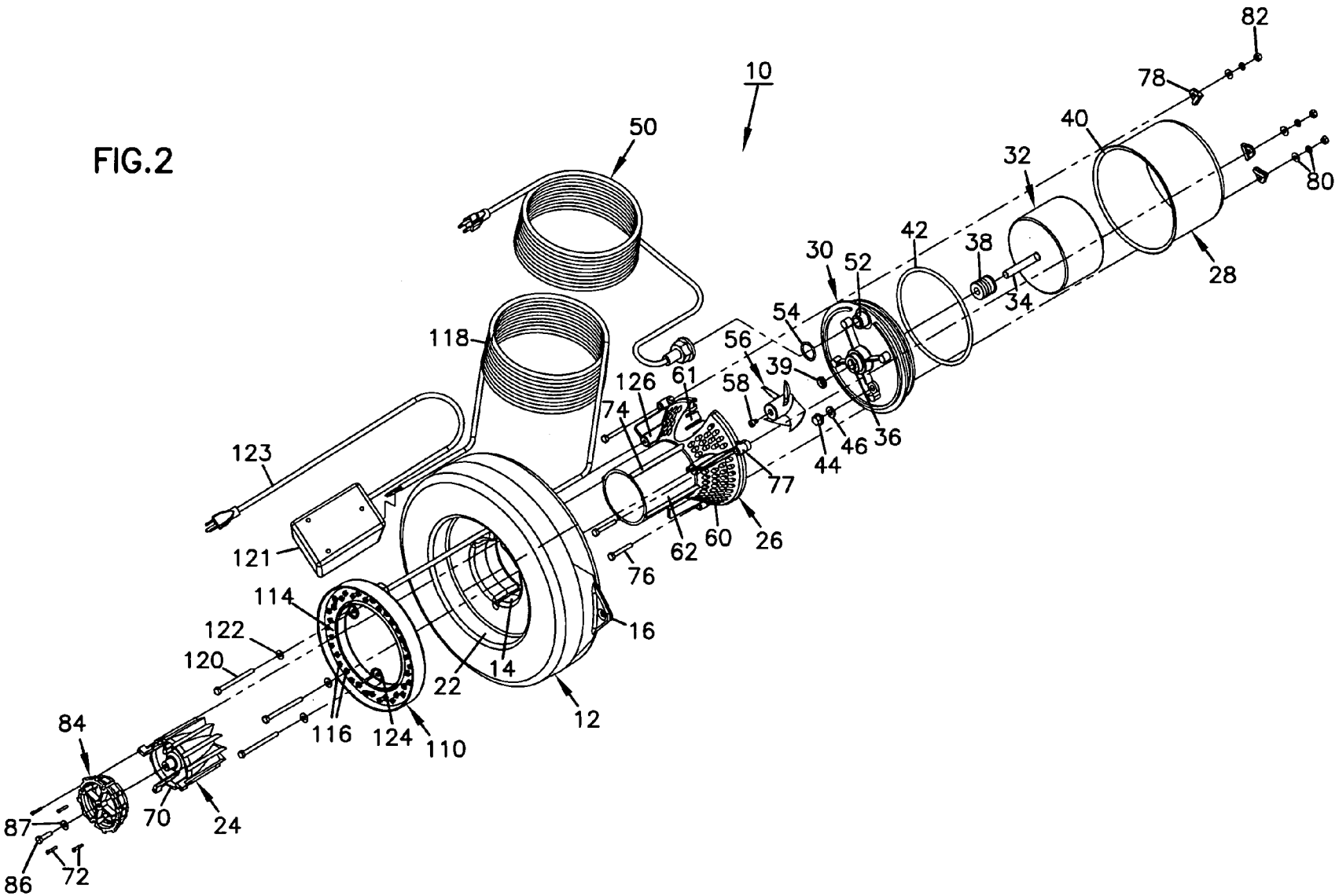
FIG. 2 is an exploded perspective view of the apparatus of FIG. 1.
Figure 3:
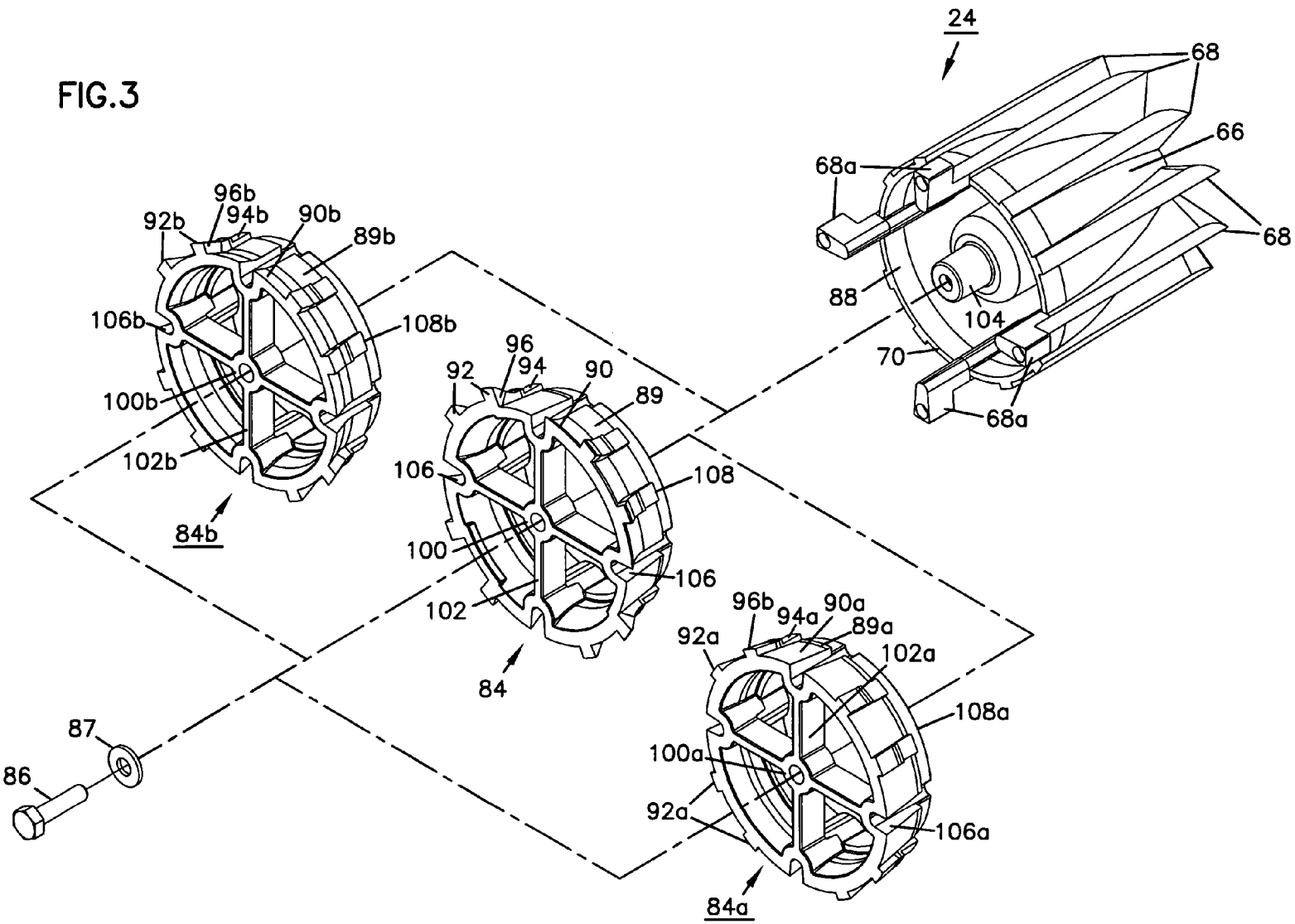
FIG. 3 is an exploded perspective view showing, in kit format, alternative nozzles, which may be attached to an upper pump housing according to the present invention.
Figure 4:
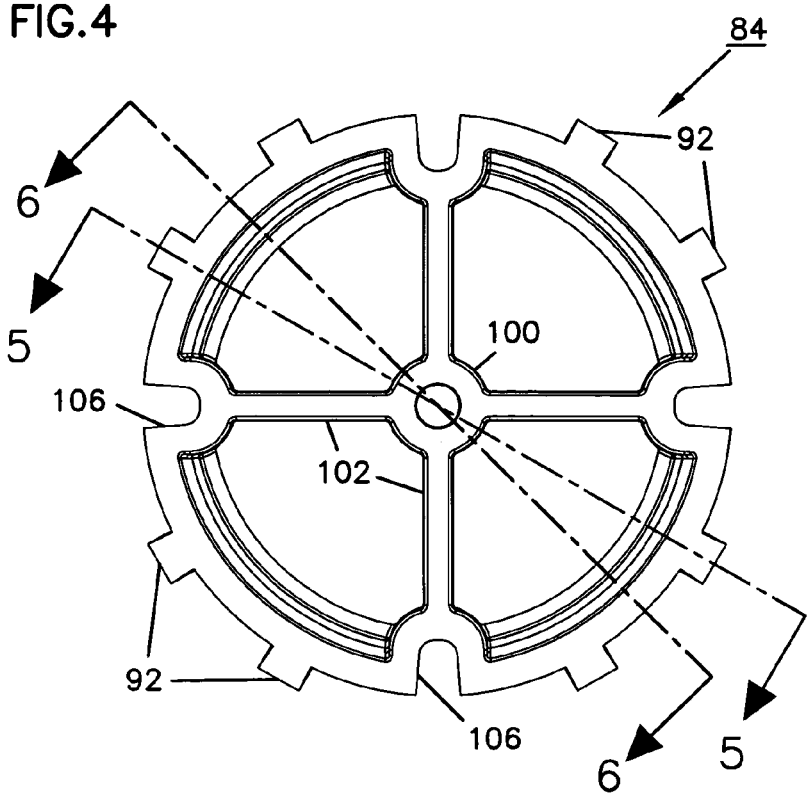
FIG. 4 is a top plan view of a first design of a nozzle according to the present invention.
Figure 5:
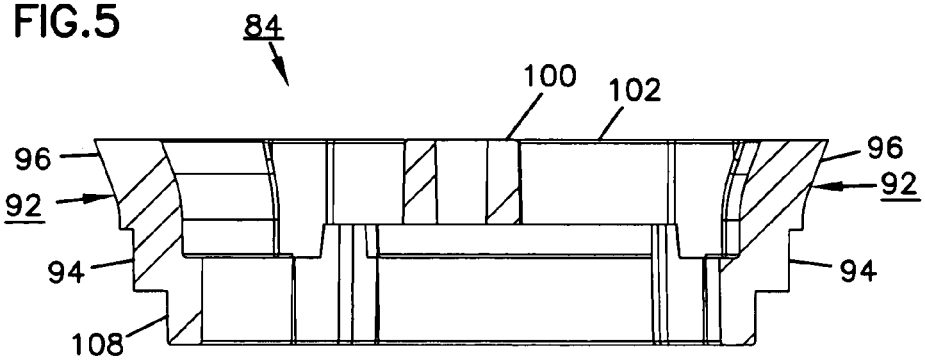
FIG. 5 is a view taken along line 5-5 of FIG. 4.
Figure 6:
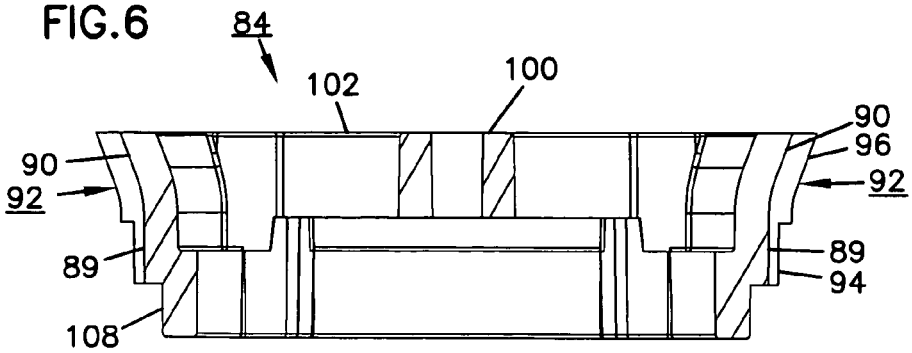
FIG. 6 is a view taken along line 6-6 of FIG. 4.

As shown best in FIGS. 2 and 3, selective ones of the vanes 68 of the upper housing have upwardly extending portions 68*a* with enlargements sized to receive and pass bolts 72. The upper housing 24 is connected to the lower housing 26 by bolts 72 (shown in FIG. 2). The bolts 72 pass through the extensions 68*a* and are received within aligned boss 74 formed on the outer surface of the cylindrical portion 62 as best shown in FIG. 2. The lower housing 26 is secured to the can 28 by bolts 76 which pass through a boss 77 on lower pump housing 26. The bolts 76 engage a retaining clip 78 and washers 80 and nut 82. The clip 78 abuts the can flange 40 to urge the can 28 and cover 30 into tight engagement with the base of the conical portion 60.

A nozzle 84 is attached to the upper pump housing 24 by a screw 86 and washer 87. The nozzle 84 has recessed portions 106 sized to receive the extended vanes 68*a*.

It is the function of the nozzle 84 to direct the water flow from the upper pump housing 24 into a plurality of discreet streams of water spray, which are arranged in an ornamental pattern. Accordingly, the outer annular surface of the nozzle 84 is not a true cylinder. Instead, the outer annular surface has a lower cylindrical portion 89 aligned with the upper cylindrical portion 88 of the upper pump housing.

The nozzle 84 (shown best in FIGS. 3 and 4-6) includes an upper flow directing surface 90 to direct the water flow outwardly and away from a nozzle 84. Surface 90 is at an outwardly projecting angle to surface 89.

A plurality of spacer ribs 92 is disposed on the outer annular surfaces 89, 90 of the nozzle 84. A lower end 94 of the spacer ribs 92 is aligned with and provides a continuing surface of the vanes 68. Accordingly, the volume between opposing ribs 92 is a continuation of the water flow volume between the vanes 68 resulting in a plurality of discreet streams of water flow from the nozzle 84.

The upper surface 90 of the annular surface is angled outwardly to project water outwardly at a desired angle. In order to prevent adjacent water streams from merging (and, thus, not presenting the desired ornamental appearance of discreet streams), an upper portion 96 of the ribs 92 is also angled outwardly to provide an additional separation of water streams to prevent merger of the water streams.

The nozzle includes a central boss 100 supported by internal ribs 102. The boss 100 is aligned with a central core 104 of the upper pump housing 24. The bolt 86 is passed through the washer 87 and through the boss 100 and threadedly received within the core 104.

The amount of angular deflection of the upper surfaces 90 has a material effect on the spread of the spray pattern exiting the fountain 10. In order to achieve different ornamental effects, it may be desirable to alter the amount of angular displacement of the surface 90 from the cylindrical lower portion 89. As a result, alternative nozzle designs may be secured to the upper pump housing 24.

Figure 7:
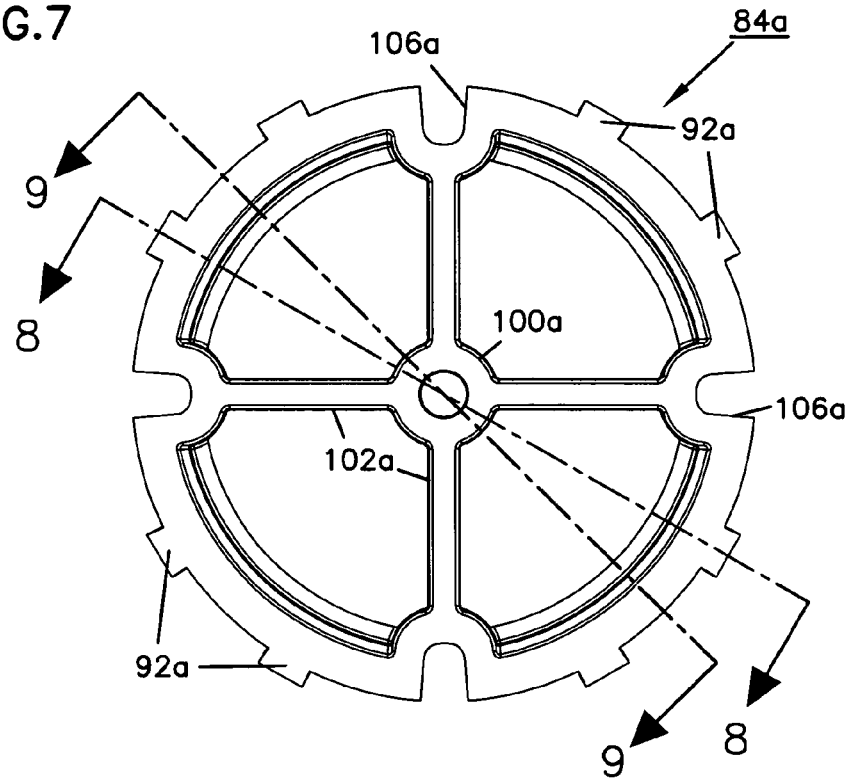
FIG. 7 is a top plan view of a second design of a nozzle according to the present invention.
Figure 8:
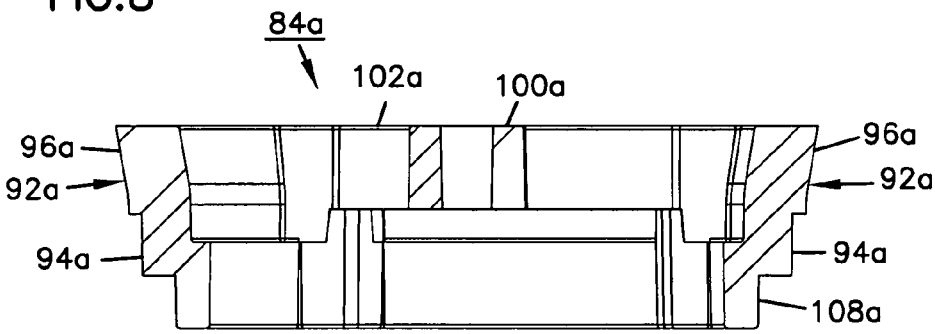
FIG. 8 is a view taken along line 8-8 of FIG. 7.
Figure 9:
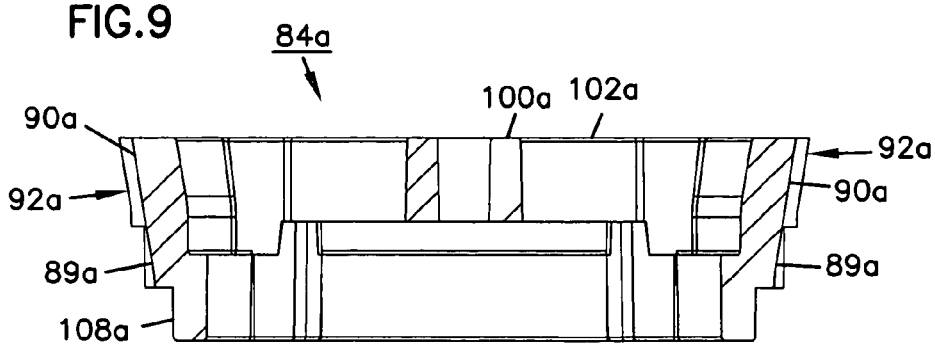
FIG. 9 is a view taken along line 9-9 of FIG. 7.
Figure 10:
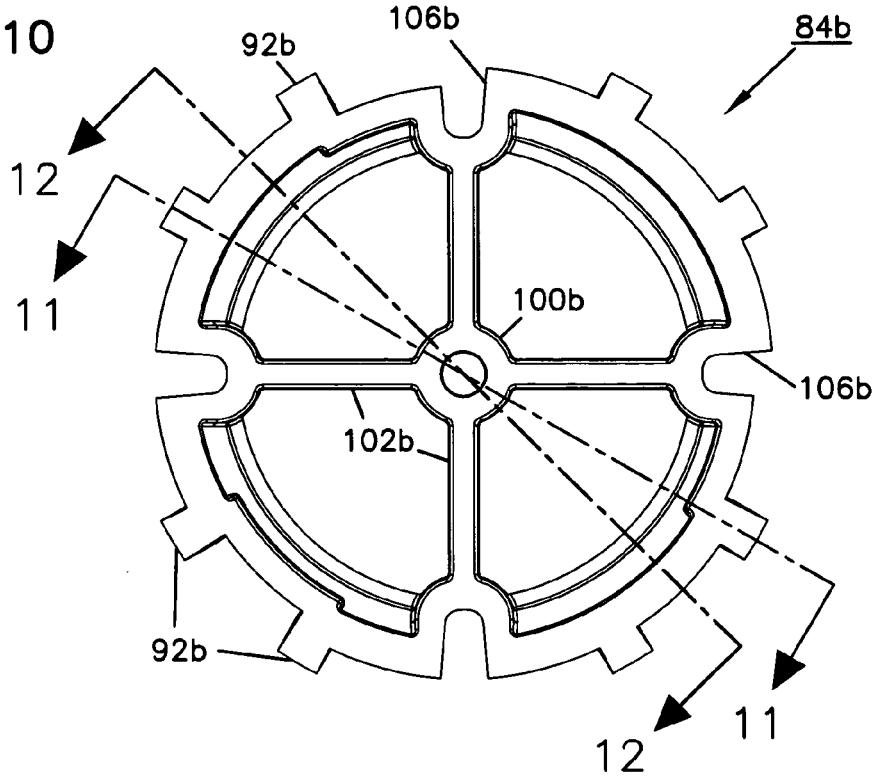
FIG. 10 is a top plan view of a third design of a nozzle according to the present invention.
Figure 11:
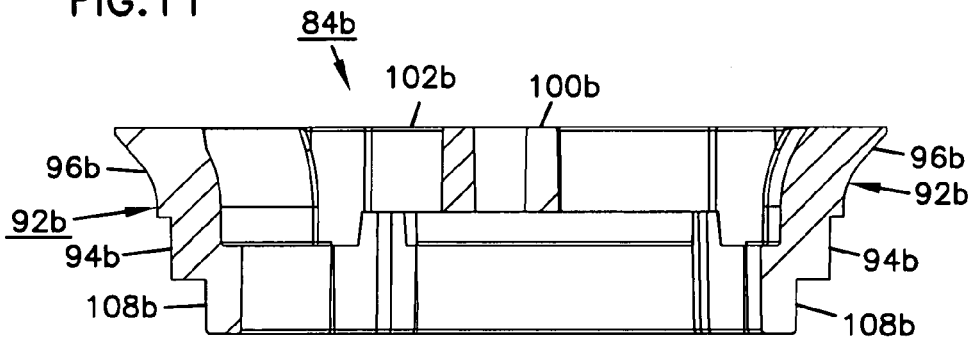
FIG. 11 is a view taken along line 11-11 of FIG. 10.
Figure 12:
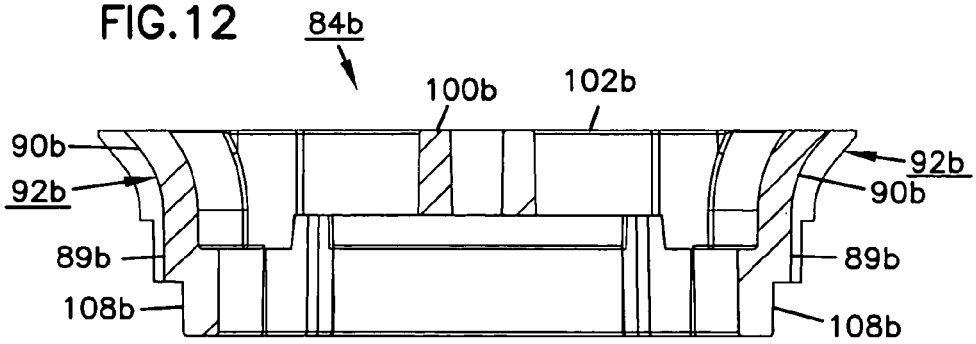
FIG. 12 is a view taken along line 12-12 of FIG. 10.

FIG. 3 illustrates alternate nozzle designs 84*a* (shown separately in FIGS. 7-9) and 84*b* (shown separately in FIGS. 10-12). It will be appreciated that the alternative designs have components in common with that of nozzle 84 and identical thereto. Similar components are similarly numbered between the various alternatives with the addition of "a" and "b" to distinguish the embodiments.

In nozzle 84*a*, the upper deflection surface 90*a* angles away from the lower conical surface 89*a* by only a shallow angle to create a more upwardly projecting stream of water. Since a shallow deflected stream is less likely to merge with adjacent streams, the upper portion 96*a* of the rib 92*a* is only shallow angled from the lower portion 94*a* of the rib 92*a*.

In the embodiment of nozzle 84*b*, the upper deflection portion 90*b* is at a steeper angle to the lower conical portion 89*b* than that of nozzle 84 to spread out a spray pattern more than the spray pattern of nozzle 84. Since spray patterns which are more spread out have a higher likelihood of merging together, the upper portions 96*b* of ribs 92*b* are similarly angled outwardly at steeper angle.

In all of the embodiments, the ribs 92, 92*a*, 92*b* align with vanes 68 and the recesses 106, 106*a* and 106*b* align with the extended ribs 68*a* such that each of the nozzles 84, 84*a* and 84*b* can easily be slipped on to the upper end 70 of the upper pump housing 24 and attached thereto by the screw 86 and washer 87. As a result, a nozzle can be replaced simply by removing one screw 86, sliding the nozzle off of the upper pump housing 24 and replacing it with a different nozzle which is then held in place by securing the screw 86. This provides for a very rapid change of nozzles when desired. Each of the nozzles 84, 84*a*, 84*b* has an inwardly extending conical member 108, 108*a*, 108*b* to abut against an inner surface 88 of the conical wall 66 to securely hold and position the nozzle 84, 84*a*, 84*b* axially on upper pump housing 24.

To illuminate a spray pattern produced by the nozzles, a lighting assembly 110 (FIGS. 1 and 2) is provided. The lighting assembly 110 includes a carrier platform 112 sized to be received within the recess 22 of the float 12. The platform 112 has attached bolt-receiving eyelets 124. Bolts 120 are passed through washers 122 and through the eyelets 124. The bolts are threaded into bosses 126 on the lower pump housing 26.

A ring-shaped board 114 is carried on the platform with the ring board 114 surrounding and positioned beneath the nozzle 84. The board 114 carries a plurality of light emitting diodes 116 which are arranged in two concentric circles on the ring 114. The circles offset in order to increase a density of light emitting diodes 116 on the ring 114.

A lighting cord 118 is connected to the diodes with the electrical components of the cord and the ring 114 being water sealed in any suitable manner such as by a resin coating or the like to prevent shorting of electrical components. The cord 118 is connected to a transformer 121, which in turn is connected to a power cord 123 to be plugged into any conventional wall outlet. The transformer 121 reduces the power voltage to apply 12-volts to the light emitting diodes 116 to illuminate the diodes 116 on the upper surface of the board 114.

With the arrangement disclosed, the light ring 114 is recessed within the float 12. Therefore, it is at least partially hidden from view and presents a low profile when the fountain 10 is placed within the body of water. The light emitting diodes 116 are evenly distributed around the inner diameter of the float and outside the inner diameter of the nozzle 84. This optimizes the reflection and refraction of light for even distribution as well as higher efficiency. Light emitting diodes 116 are preferred since they avoid failure as commonly experienced with incandescent lights (due to temperature changes and vibration).

With the structure thus described, a compact, efficiently manufactured and designed fountain 10 is provided. The fountain 10 is particularly suitable for low horsepower applications (e.g., one-quarter horsepower). The sub-housing 24 with nozzle 84 permits quick changing of nozzles to provide multiple display patterns of sprays. The patterns can be changed by removal of a single screw 86. Also, future patterns of nozzles 84 can be designed and manufactured and adapted to the present design.

If desired, the nozzle 84 and upper pump housing 24 may be replaced with an inverted cone (not shown). The apex of the cone can be attached to the propeller 56 with a screw 58 retaining the cone on the propeller 56. Such a cone creates a conical spray of water which is effective for aeration but not as ornamental as the spray patterns produced by a nozzle 84.

It has been shown how the objects of the present invention have been attained in the preferred manner. Modifications and equivalents are intended to be included within the scope of the appended claims.

What is claimed is:

1. A floating fountain apparatus for a placement in a body of water, said apparatus comprising:

an annular float having a central opening with said float formed to be buoyant in water and having an upper side and a lower side, the float having an inner annular recess at the upper side and adjacent the central opening;

a pump secured to said float and positioned with a center of mass below said lower side;

said pump having a propeller positioned to direct water through said central opening from said lower side toward said upper side;

a pump housing positioned to receive water flow from said propeller and direct said water flow to a nozzle outlet;

an annular lighting assembly positioned within said annular recess;

said lighting assembly including a frame releasably secured to said pump housing by a releasing mechanism accessible from said upper side, said frame carrying a mounting ring surrounding said nozzle outlet and having electrical components sealed from water infiltration;

a plurality of light emitting diodes carried on said mounting ring with light emitting surfaces exposed on an upper surface of said mounting ring.

2. An apparatus according to claim 1 wherein said mounting ring is positioned near a water level.

3. An apparatus according to claim 1 further comprising:

said pump housing including an outer member and an inner member mounted therein with opposing surfaces defining an annular fluid flow pathway around a flow axis and positioned to receive and direct said water flow;

a water nozzle mounted on said nozzle outlet and having a surface configuration to receive said water flow from said fluid flow pathway and project water from said fountain in a pattern.

4. An apparatus according to claim 3, further comprising:

a plurality of vanes extending between said outer member and said inner member to divide said annular fluid flow pathway into a plurality of individual fluid flow pathways circumferentially spaced around said flow axis;

said nozzle having a plurality of ribs disposed to align with said plurality of vanes.

* * * * *